US005524603A

United States Patent [19]

Menzer

[11] Patent Number: 5,524,603

[45] Date of Patent: Jun. 11, 1996

[54] PISTOL TYPE SPEAR GUN

[76] Inventor: Hubert L. Menzer, 6941 NW. 14th St., Plantation, Fla. 33313-5307

[21] Appl. No.: 364,820

[22] Filed: Dec. 27, 1994

[51] Int. Cl.[6] ..... F41B 7/04

[52] U.S. Cl. ..... 124/20.3; 124/22

[58] Field of Search ..... 124/17, 20.1, 20.3, 124/21, 22, 26, 27

[56] References Cited

U.S. PATENT DOCUMENTS

| | | | |
|---|---|---|---|
| 306,422 | 10/1884 | Peters | 124/22 |
| 1,837,734 | 12/1931 | Sword | 124/22 |
| 2,496,217 | 1/1950 | Kearny | 124/22 |
| 2,818,849 | 1/1958 | Woods . | |
| 2,896,604 | 7/1959 | Rebikoff . | |
| 3,016,891 | 1/1962 | Ebeling . | |
| 3,585,979 | 6/1971 | Hendricks . | |
| 4,297,985 | 11/1981 | Rodriguez | 124/22 |
| 4,359,999 | 11/1982 | Garofalo . | |
| 4,573,445 | 3/1986 | Webb et al. | 124/22 |
| 4,759,336 | 7/1988 | Frain . | |
| 4,895,128 | 1/1990 | Okada | 124/22 |
| 4,962,747 | 10/1990 | Biller | 124/40 |

FOREIGN PATENT DOCUMENTS

| | | | |
|---|---|---|---|
| 1188935 | 9/1959 | France . | |
| 1221853 | 6/1960 | France . | |
| 2292208 | 7/1976 | France . | |
| 237029 | 7/1925 | United Kingdom | 124/22 |

*Primary Examiner* Eric K. Nicholson
*Assistant Examiner* John A. Ricci
*Attorney, Agent, or Firm* Julian C. Renfro

[57] ABSTRACT

A pistol type spear gun for use with a spear shaft comprising a body member having a handle portion adapted to be grasped in the hand of a user, with a trigger member positioned so as to be squeezed by the user on occasion. An elongate passage extends through the body member in approximately a right angle relationship with the handle portion, with this passage being adapted to receive a spear shaft. An elastic power band is attached to the body member and the base end of the spear shaft is able to be brought into contact with a mid portion of the power band when the spear shaft is moved in the cocking direction. The trigger member has a shaft contact point moved into forcible contact with a spear shaft in the elongate passage when the trigger member is squeezed. The spear shaft, when movement thereof in the cocking direction is continued, causes the elastic power band to stretch, with the trigger member, when squeezed by the user, serving to hold the spear shaft in a cocked position until the trigger member is released. I prefer to enlarge the height of the elongate passage above the location where the shaft contact point is brought into contact with the spear shaft, such enlargement of the elongate passage permitting the spear shaft to temporarily assume a bowed condition in which forward movement of the spear shaft through the elongate passage is inhibited.

5 Claims, 3 Drawing Sheets

PISTOL TYPE SPEAR GUN

BACKGROUND OF THE INVENTION

Conventional spear guns may be classified according to two general types, with one being a pneumatic spear gun, which utilizes an air-driven piston or a $CO_2$ cartridge to drive the spear shaft down a rifle-like barrel, and the other being a rubber-powered or sling-type spear gun, in which one or more elastic bands propel the spear shaft.

Inasmuch as the water is highly resistant to the progress of a spear shaft for any great distance, high muzzle velocity is necessary to propel the spear shaft with any great force.

The pneumatic type of spear gun using a pumping arrangement is advantageous in that it is a relatively accurate device, allowing accurate aiming of the spear shaft. However, it is disadvantageous inasmuch as the power to drive the spear shaft is limited by the physical strength of the user of the gun inasmuch as during loading, the air is further compressed and the piston set by the diver himself.

The only way to increase the power of this type of pneumatic spear gun is to increase the initial pressure of the compressed air. If such initial pressure were to be too great, however, the diver would not be able to overcome it during each loading. Thus, each pneumatic spear gun necessarily has a limit to the maximum power output thereof, which also is directly dependent upon the diver's strength.

The type of pneumatic spear gun using a $CO_2$ cartridge does not require pumping, and the user can aim down the barrel of the gun, but it has a very short range. Furthermore, the gas seal often leaks, maintenance and cost is high, and popularity is low.

In comparison with these types of pneumatic spear guns, the rubber-powered spear gun has the considerable advantage of a greater power output, and therefore, the possibility of greater spear shaft range. However, one disadvantage is the offset aiming accuracy associated with some embodiments of the band powered gun.

With conventional band powered spear guns, a definite amount of strength is usually involved, and one way of cocking the gun is to place the gun stock against the user's stomach or chest and to pull back with both arms on the elastic band that is then fitted in a notch in the spear shaft or harpoon. To assist in cocking the gun, the butt end of the gun stock is sometimes provided with a soft packing or the like.

Conventional band powered guns with the usual type of cocking arrangement provide no adjustment of shaft velocity, and a maximum arm strength effort to load such a gun must necessarily take place prior to firing the spear shaft in the direction of the intended target.

It is an important object of this invention to utilize a cocking arrangement of a type such that the power band of the gun can be stretched to a desired extent by almost anyone, irrespective of age or reasonable physical strength, with such cocking able to be accomplished while the user is swimming on the surface, under water, or in open air, as may be desired by the user.

Another object of this invention is to provide a cocking procedure wherein the center portion of the power band is drawn rearwardly by rearward movement of the spear shaft, and after the power band has been suitably tensioned, the spear shaft is momentarily immobilized by the user firmly gripping the trigger member, with the arrangement being such that successive stretchings of the band can be accomplished, to provide a variety of power output possibilities that can be maintained by suitable pressure applied to the trigger of the device by the user. As should be apparent, more potential energy is able to be stored in the power band in accordance with this advantageous procedure than could be accomplished using ordinary procedures.

SUMMARY OF THE INVENTION

In accordance with this invention a Pistol Type Spear Gun involving a one-piece body member is provided, and because of its advantageous construction, it can be totally operated with one hand. The body member has an elongate passage therethrough, into which a spear shaft can be readily inserted. A handle portion is provided on the body member, which resides in approximately a 90° relationship to the elongate passage through which the spear shaft is to be inserted. In the handle portion a trigger member is pivotally mounted, with the upper interior portion of the trigger member having a shaft contact point or pressure pad that on occasion extends into the above-mentioned elongate passage, into contact with the spear shaft when such is in place.

Components are provided on each side of the rear part of the body member for receiving the two ends of one or more large power bands of unitary construction, with the rear central portion of the power band having a receptacle for receiving the rear end of the spear shaft. Consequently, when the user has inserted the shaft into the elongate passage through the body member, and placed the rear end of the shaft in contact with the receptacle located on the rear central portion of the power band, the user can then proceed to force the spear shaft rearwardly so as to cause the power band to stretch to a considerable extent. This is immediately followed by a gripping of the spear shaft by the use of the trigger member, to inhibit its further movement. The user can then apply another increment of tension by the spear shaft to the power band while slightly easing the force applied to the trigger, with this being followed by the user again tightly gripping the spear shaft by the use of the trigger member, thereby developing an increased amount of potential energy in the power band. The proper operation of my novel trigger arrangement thus enables the user to immobilize the spear shaft between successive cocking efforts, thereby making it readily possible to develop such a large amount of tension in the power band as to cause, when the trigger is released, the spear shaft to leave the body member with considerable velocity.

Whereas sling-type spear guns will propel a spear shaft up to 15 feet in the water, the present invention, because several distinct band-tensioning or cocking efforts can be brought about, can be utilized for propelling a spear shaft some 30 feet or more through the water. However, in some instances, the user may desire to select a lesser distance.

Because of the advantageous trigger member design in accordance with this invention, by the user squeezing the trigger member to cause the shaft contacting point or pressure pad to move into firm contact with the spear shaft, the spear shaft can be prevented from prematurely exiting through the elongate passage in the body member, despite the fact that the power band has been stretched through successive cocking efforts to a considerable extent.

Whereas a "Hawaiian triggerless sling type spear gun" at all times requires two-handed operation in order to stretch the power band, hold in cocked position, aim, and then fire the spear shaft, my novel device can be entirely operated by one hand.

Quite advantageously, the user can cock the spear gun—that is, cause the power band to stretch to a considerable extent—immediately prior to intended use of the spear gun, and by the use of the shaft contact point or pressure pad provided on the upper interior portion of the trigger member, the user can hold the spear shaft in the "ready" condition. The spear shaft can thereafter be launched almost instantaneously and in a highly accurate manner by the user relaxing his grip on the trigger. This "one-handed" operation of the device is one of the principal features of my invention.

By the use of this invention a user can cause a spear shaft to be fired much further than by the use of the "Hawaiian Sling," the gas gun or the pole gun. This is because the user can, through the previously described successive cocking efforts, stretch the power band much further than is possible using the Hawaiian Sling.

Presuming for the moment that the user is right handed and is holding the handle portion of the body member in his or her right hand, the left hand can be used to move the spear shaft in the power-band stretching direction. At such point the user then squeezes the trigger to hold the spear shaft motionless, with the power band in the stretched position. Then, the user can get a new grip on the spear shaft with his or her left hand, and thereafter move the spear shaft in the direction causing the power band to stretch even further, with the user removing some trigger pressure during such rearward movement of the spear shaft. This is followed by a reapplication of firm trigger pressure, so as to immobilize the spear shaft and thereby hold the power band in the latest stretched condition. After a desired number of successive band-stretching efforts, the user can then use his or her free left hand for any other purpose, for solely with his or her right hand, he or she can aim the spear at the intended target and then release the trigger to permit the spear shaft to speed accurately toward the target.

Although handicapped users may represent a minority, there are many who are handicapped only to the extent of one arm, one hand, or the fingers of one hand. It is to be understood that if the user has the use of only one hand, he or she could cock the device to a desired tension by pushing the tip of the spear shaft against a rock or other fixed object, and as the power band becomes further and further stretched, the user grips the trigger tightly enough so as to hold the spear shaft in the position in which the power band is most tightly stretched.

It is therefore a primary object of this invention to provide a pistol type spear gun that can be manufactured at low cost yet utilized quite accurately and effectively for a number of specific purposes.

It is another object of this invention to provide a pistol type spear gun equipped with a single action, pivotally mounted trigger able to make direct contact with the spear shaft, with the arrangement being such as to require a minimal amount of moving parts and be operable through a succession of band stretching efforts by a person of average strength, to bring about a desirable amount of potential energy being stored in the power band, even by a person who is handicapped by either limited use or no use of one arm, or is limited to the use of only one hand.

It is yet another object of this invention to provide a pistol type spear gun utilizing one or more power bands able to be readily tensioned to any of a variety of selected tensions, while involving minimal effort on the part of the user.

It is yet still another object of this invention to provide a pistol type spear gun making possible a procedure that can readily result in a power band being stretched to a relatively great extent, thus making it possible for a spear shaft to be projected for a greater distance than is customarily possible for a relatively simple, inexpensive device.

It is yet still another object of this invention to provide a highly advantageous trigger mechanism for a spear gun, by the use of which a spear shaft can be selectively immobilized against longitudinal motion in the forward direction, but permitting effective cocking motion to proceed.

It is yet still another object of this invention to provide a pistol type spear gun that can be advantageously used underwater, but which, because of its versatile construction, is not to be limited to such usage.

These and other objects, features and advantages of this invention will become more apparent from a study of the appended drawings.

DETAILED DESCRIPTION

Figure 1:
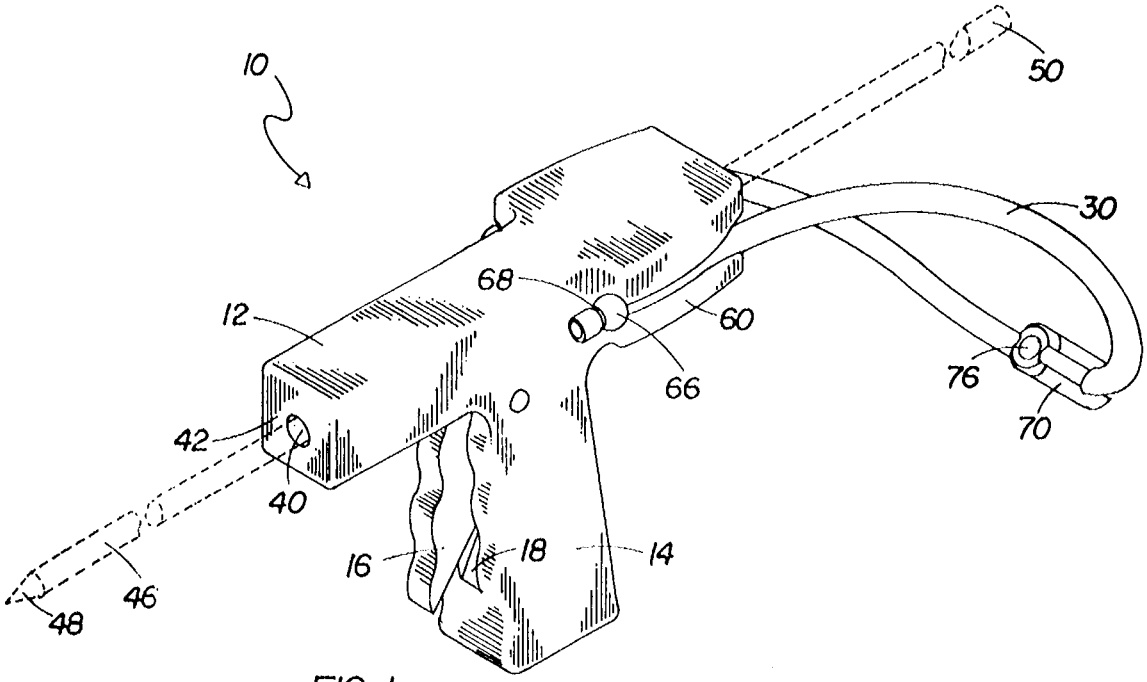
FIG. 1 is a perspective view of my novel pistol type spear gun, showing the manner in which a spear shaft extends through an aperture provided on the centerline of the spear gun, with this view also depicting the at-rest position of a power band utilized for propelling the spear shaft to a selected destination.

With initial reference to FIG. 1 it will be seen that I have provided a pistol type spear gun 10, involving a body member 12 of one-piece construction. I utilize non-corrosive material, such as an industrial grade plastic in the construction of my novel spear gun, although I am not to be limited to this. The body member 12 has a handle portion 14 adapted to be grasped in the hand of a user, with a trigger member 16 being pivotally mounted in a trigger pocket 18 located in a forward portion of the handle 14.

Indicated in FIG. 1, but visible more clearly in subsequent figures, is an elongate passage 40 provided through the body member 12, through which passage a spear shaft 46 may extend. The elongate passage 40 extends through the body member 12 in approximately a right angle relationship with the handle 14, with the body member 12 having a front end 42 and a rear end 44. Obviously, the handle 14 can be positioned a number of degrees away from a precise right angle relationship to the longitudinal passage 40 and still be regarded as residing in an approximate right angle relationship to the passage 40.

The spear shaft 46 has a pointed front end 48 and a base end 50. As will be noted in FIG. 3, and seen in greater detail in FIG. 7, a portion 52 of the passage 40 in the vicinity of the trigger pocket 18 is of increased height, for a purpose explained in detail hereinafter.

Figure 2:
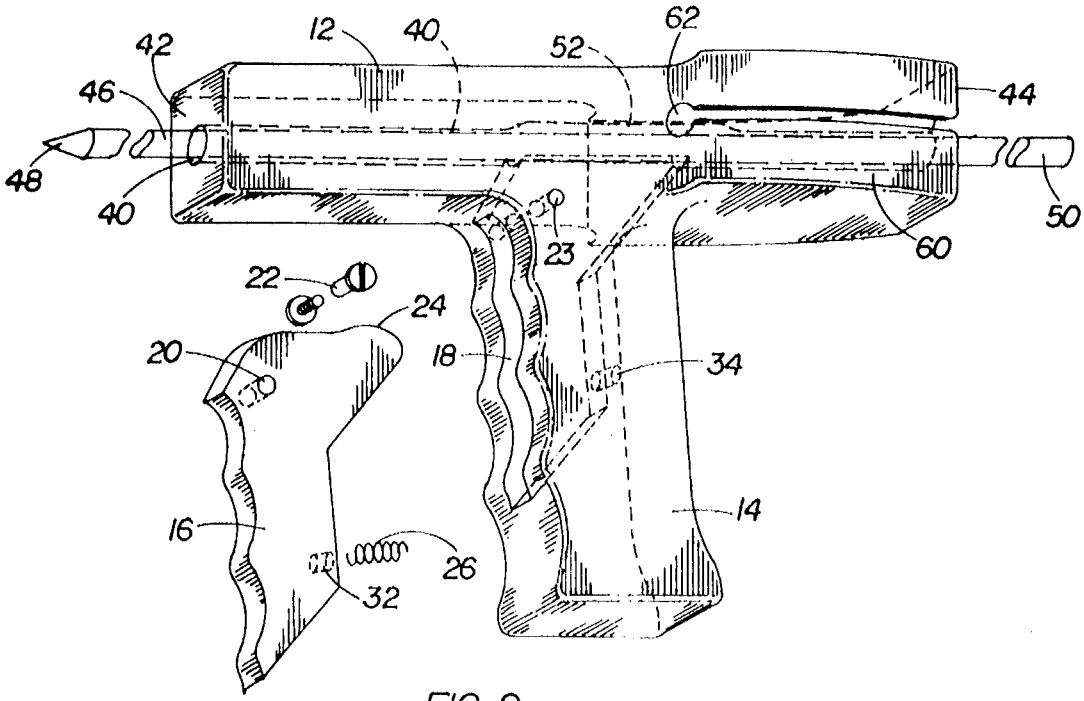
FIG. 2 is a somewhat different type of perspective view, with the trigger member of the spear gun shown in an exploded relationship to the handle, and with dashed lines being utilized for revealing certain internal construction.

A mounting hole or trigger post hole 20 is provided in an upper portion of the trigger member 16, as visible in FIG. 2. Through the mounting hole 20, a trigger post 22 may be inserted, as depicted in FIG. 2, so as to mount the trigger member 16 in a pivotal manner in the handle portion 14. Visible in FIG. 2 as well as FIG. 3 is the trigger spring 26, which is a compression spring utilized to bias the trigger member 16 forwardly.

A spring pocket 32 is provided on the rear side of the trigger member 16, and a spring pocket 34 is positioned in the handle member 14, with these pockets forming an effective mounting arrangement for the spring 26. It is to be understood that the trigger member 16 is positioned on the handle 14 in such a way as to be contacted by at least one finger of the user during the grasping of the handle in the hand of the user, but typically several of the user's fingers are in contact with the trigger member during the operation of my novel pistol type spear gun. Significantly, and as illustrated in FIG. 2, the upper end of the trigger member 16 is provided with a shaft contact point or pressure pad 24, and FIG. 3 reveals that the shaft contact point or pressure pad 24 extends upwardly through an aperture in an upper interior portion of the handle, so as to be able to be brought into firm contact with the spear shaft 46 on occasion. This important aspect of my invention will be discussed at greater length hereinafter.

Figures 3, 4, 5, 6:
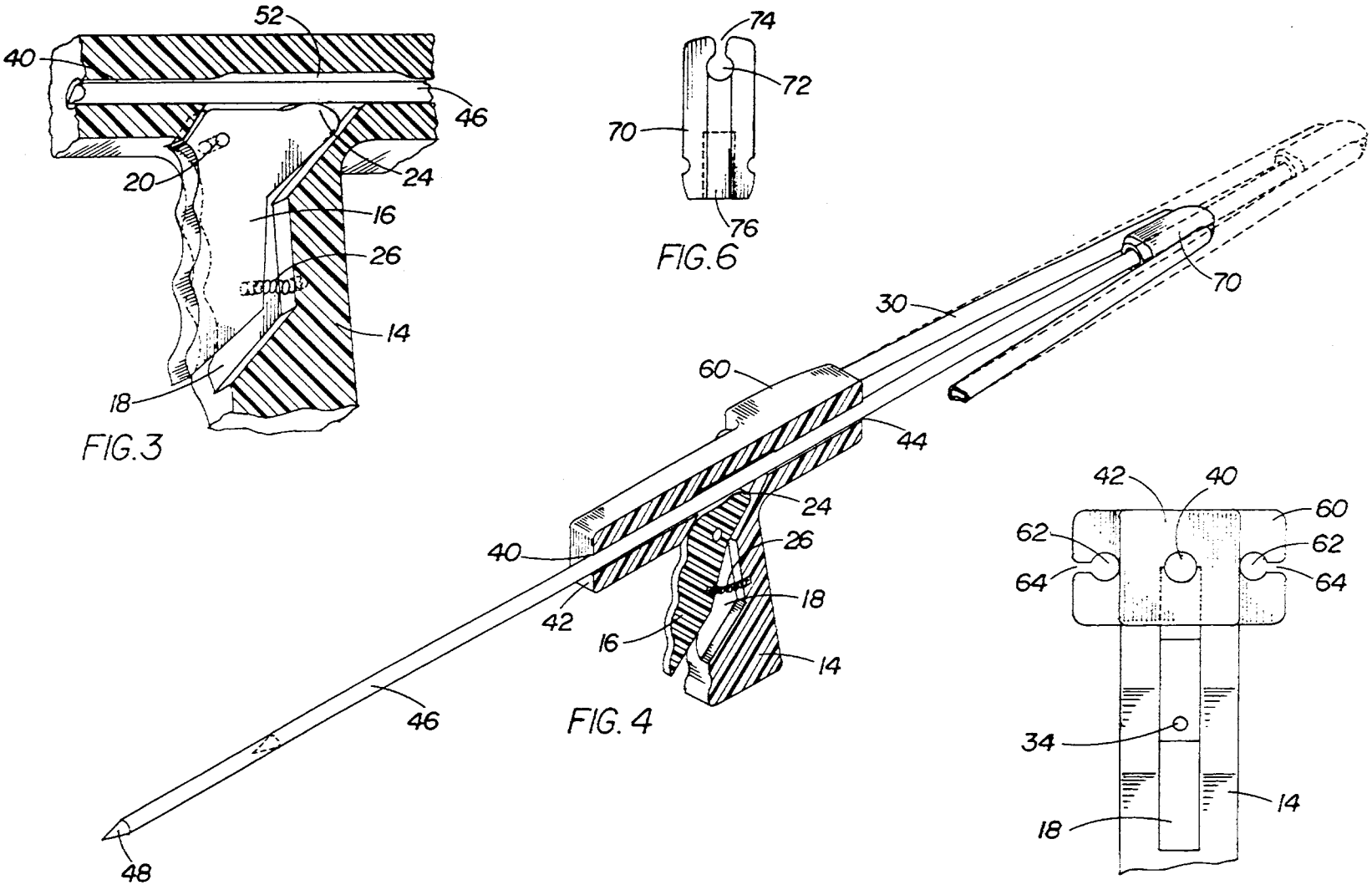
FIG. 3 is a fragmentary view showing the trigger member in an operative relationship in the handle, and with the shaft contact point or pressure pad of the trigger member in touching contact with the spear shaft, so that the spear shaft can, on occasion, be restrained against movement along the longitudinal aperture of the spear gun in the forward direction.
FIG. 4 is a view generally resembling FIG. 1 but with a portion of the body member broken away to reveal internal construction, and with the power band shown in a first extended position by the use of full lines, and shown as having been stretched to a further extent by the use of dashed lines.
FIG. 5 is a fragmentary front view showing certain details of the attachment arrangement utilized on the rear sides of the spear gun, with this arrangement serving as an attachment means for the two ends of the power band.
FIG. 6 is a fragmentary view of a preferred construction for the spear shaft holder that is utilized in the mid portion of the power band, for receiving the base end of the spear shaft.

As illustrated in FIGS. 1, 2 and 5, attachment means 60 are provided on the body member 12 adjacent the rear end 44 of the elongate passage 40, to which attachment means, each end of the elastic power band 30 can be attached. As shown in FIG. 5, I provide a hole 62 on each side of the attachment means 60, with each hole being accessed by means of a slot 64. I typically secure an end of the power band 30 to the attachment means 60 by placing a restraint means or enlargement 66 in the end of the band, as shown in FIG. 1. The end of the band near the restraint means 66 is then slid through the slot 64, until such time as the restraint means 66 comes to rest against the front end of the respective hole 62. The restraint means 66 may take the form of a plastic ring held in place by a crimp ring 68, or other such device may be used, and I am not to be limited to any particular arrangement. As is obvious, the same procedure is used for placing a restraint means on both ends of the power band 30.

The arrangement I use is such as to permit the base end 50 of the spear shaft 46 being able to be brought into contact with a mid portion of the power band 30 when the spear shaft 46 is moved longitudinally along the elongate passage 40 in the band-stretching direction, which I prefer to call the cocking direction. To prevent slippage, I utilize a spear shaft holder 70 in the mid portion of the power band 30, with a preferred embodiment of the shaft holder 70 being illustrated in FIG. 6. The shaft holder 70 is provided with an aperture 72 accessed by a slot 74, with the arrangement being such that by stretching the power band to some extent, the band can be slid through the slot 74 until it resides in the aperture 72, thus causing the shaft holder 70 to be secured in a mid portion of the power band 30.

A hole 76 is provided in a front portion of the shaft holder, with the diameter of this hole being such that the base end 50 of the spear shaft 46 fits relatively snugly into the hole 76. However, the base end does not fit so tightly in the hole 76 as to inhibit the spear shaft moving away from the shaft holder 70 when the spear shaft is launched.

As mentioned hereinbefore, an upper interior portion of the trigger member 16 has a shaft contact point or pressure pad 24 extendable into the elongate passage 40, and into contact with the spear shaft 46 when such shaft is residing in the elongate passage 40, and the trigger member is squeezed. The spear shaft 46, when movement thereof in the rearward or cocking direction is continued, serves to cause the elastic power band 30 to stretch, with the trigger member 16, when squeezed by the user, serving to cause the spring 26 to compress. Significant to this invention is the fact that the shaft contact point or pressure pad 24 is caused to move into a tight fitting relationship with the spear shaft 46 when the trigger is squeezed, thus to cause the spear shaft 46 to be held firmly in a cocked position. In other words, the power band 30 is caused to remain in the stretched condition until the trigger 16 is released.

Figure 7A:
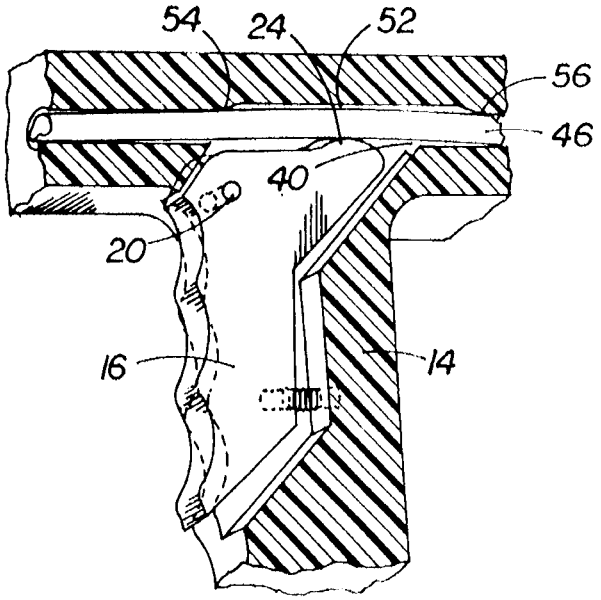
FIG. 7*a* is a fragmentary view of a portion of the elongate passage extending through the body member, with this view illustrating the increased height of the passage in the immediate vicinity of the shaft contact point or pressure pad of the trigger member, and showing the shaft contact point or pressure pad of the trigger member in forceful contact with the spear shaft.

It is important to note from FIG. 7*a* that a passage portion 52 of increased height permits a desirable degree of upward flexing of the spear shaft 46 at this location in the passage 40 at such time as the trigger is squeezed to force the shaft contact point or pad 24 tightly against the spear shaft. This brings about a highly advantageous no-slip relationship.

A basic advantage of this invention involves the fact that by providing the trigger member 16 with the shaft contact point or pad member 24 that is able to be forced into immobilizing contact with the spear shaft 46, the user can bring about an initial stretching of the power band by forcing the spear shaft rearwardly in the longitudinally disposed elongate passage 40, with this then being followed up by squeezing the trigger 16 to prevent forward motion of the spear shaft. If he or she wishes, the user can then go about moving the spear shaft still further rearwardly, during partial release of pressure on the trigger 16, so as to cause the power band 30 to be stretched still further, and to store up an additional amount of potential energy in the power band. After this further stretching, the user then squeezes the trigger tightly again, so as to again immobilize the spear shaft, but in the new position. As is obvious, the user can utilize successive band-stretching (cocking) efforts so as to bring about a desired extent of stretch of the power band 30.

In FIG. 7*a* I illustrate the effect of the user pressing hard upon the trigger member 16. As mentioned hereinabove, the elongate passage 40 extending longitudinally through the body member 12 is enlarged at location 52, in the immediate vicinity of the shaft contact point or pressure pad 24. Because of the increased height of the passage at location 52, when the user presses on the trigger, this causes the spear shaft to be bent or distorted into an upwardly offset or bowed configuration, in the general manner depicted in FIG. 7*a*. As will be noted, the bending of the spear shaft during a hard pull upon the trigger member 16 will cause the shaft to move into tight contact with points 54 and 56 in the enlarged passage portion 52. The minimal clearance of the spear shaft 46 in the elongate passage 40 is such that when the shaft has assumed the offset or bowed condition depicted in FIG. 7*a*, it will no longer pass through the longitudinally disposed passage 40.

Figure 7B:
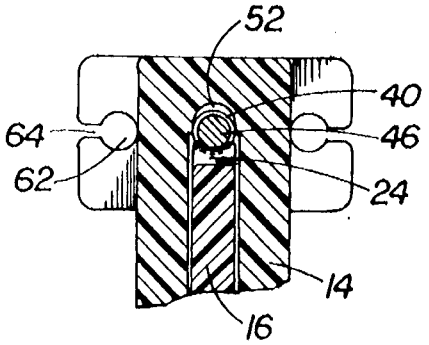
FIG. 7*b* is a cross-sectional view revealing the preferred construction of the upper portion of the trigger member known as the shaft contact point or pressure pad.

In FIG. 7*b* I illustrate a preferred cross-sectional configuration of the shaft contact point or pressure pad 24, which may be somewhat concave or of saddle-shaped configuration, so as to contact a substantial portion of the circumference of the spear shaft 46. This optional configuring of the pad 24 in this manner serves to increase contact area as well as enhancing holding power.

I am not to be limited to any particular construction of the spear shaft 46, but in one preferred embodiment, the spear shaft was ¼ inch in diameter and 5 feet long, being made of stainless steel. In this instance, the passage or barrel 40 was 9/32 inch in diameter, thus amounting to what I regard as a minimal clearance.

Figure 8:
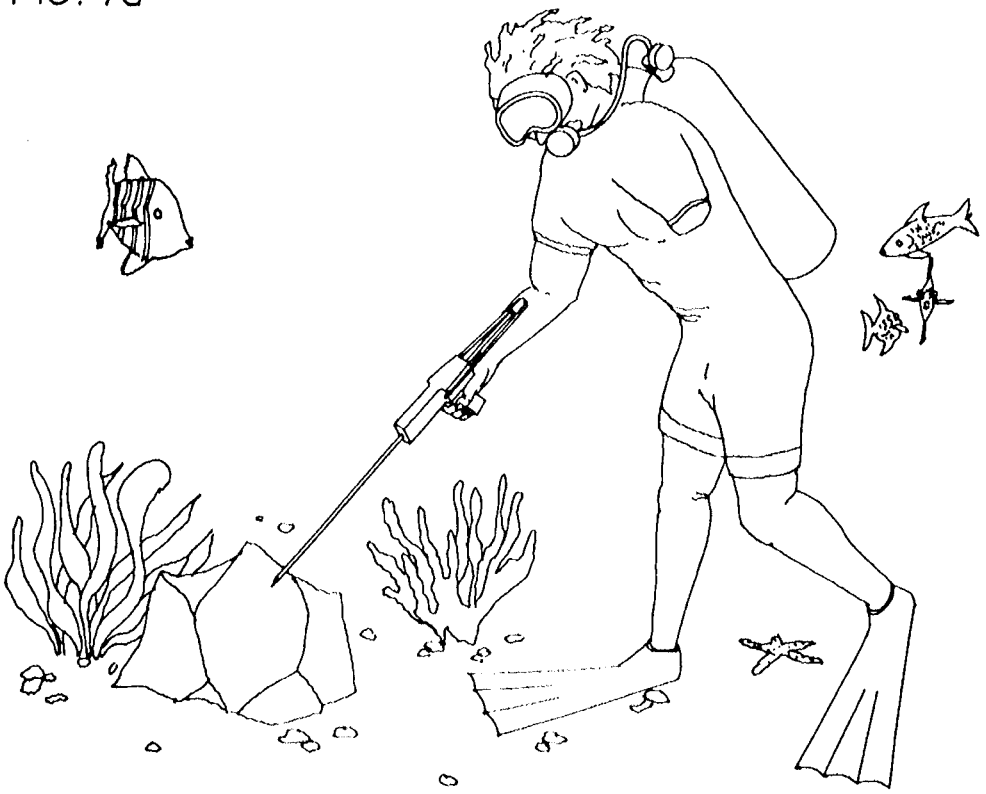
FIG. 8 is a figure indicating one procedure that a user may utilize in order to accomplish a one-handed cocking effort, involving the user pressing the tip of the spear shaft against a rock so as to bring about a selected amount of potential energy being stored in the power band.

In FIG. 8 I illustrate one procedure that a user may employ in order to accomplish a one-handed cocking effort, involving the user pressing the tip of the spear shaft 46 against a rock so as to force the spear shaft rearwardly, and to bring about a selected amount of potential energy being stored in the power band 30. As is obvious, the user must maintain some grip on the trigger member 16 during this procedure, and then he or she must tightly grip the trigger when the selected degree of power band tension has been brought about.

I claim:

1. A pistol type spear gun for use with a spear shaft, said gun comprising a body member having a handle portion adapted to be grasped in the hand of a user, a trigger member operatively mounted in said handle portion and positioned to be contacted by at least one finger of the user during the grasping of said handle by the hand of the user, an elongate passage extending through said body member in approximately a right angle relationship with said handle portion, said passage being adapted to receive therein a spear shaft having a pointed end and a base end, attachment means on said body member to which each end of an elastic power band can be attached, the base end of the spear shaft being able to be brought into contact with a mid portion of said power band when the spear shaft is moved in the cocking direction, said trigger member having a shaft contact point extendable into said elongate passage, which contact point is moved into forcible contact with a spear shaft in said elongate passage when said trigger member is squeezed, the spear shaft, when movement thereof in the cocking direction is continued, serving to cause said elastic power band to stretch, with said trigger member, when squeezed by the user, serving to hold the spear shaft in a cocked position, with the power band in the stretched condition, until said trigger member is released, the height of said elongate passage being enlarged above the location where said shaft contact point is brought into contact with the power shaft, such enlargement of said elongate passage permitting the spear shaft to temporarily assume a bowed condition in which forward movement of the spear shaft through said elongate passage is inhibited, said trigger member being spring biased away from a position in which said shaft contact point is in firm contact with the spear shaft.

2. A pistol type spear gun for use with a spear shaft, said gun comprising a body member having a handle portion adapted to be grasped in the hand of a user, a trigger member operatively mounted in said handle portion and positioned to be contacted by at least one finger of the user during the grasping of said handle by the hand of the user, an elongate passage extending through said body member in approximately a right angle relationship with said handle, with said passage having a front end and a rear end, said passage being adapted to receive therein a spear shaft having a pointed end and a base end, attachment means on said body member adjacent said rear end of said passage, to which attachment means, each end of an elastic power band can be attached, the base end of the spear shaft being able to be brought into contact with a mid portion of said power band when the spear shaft is moved in the cocking direction, said trigger member having an upper interior portion upon which a pressure pad is located, said pressure pad being extendable into said elongate passage, and into forcible contact with a spear shaft residing in said elongate passage when said trigger member is squeezed, the spear shaft, when movement thereof in the cocking direction is continued, serving to cause said elastic power band to stretch, with said trigger member, when squeezed by the user, serving as a result of pressure pad contact to immobilize the spear shaft in a cocked position with the power band in the stretched condition until said trigger member is released, the height of said elongate passage being enlarged above the location where said pressure pad is brought into contact with the spear shaft, such enlargement of said elongate passage permitting the spear shaft to temporarily assume a bowed condition in which forward movement of the spear shaft through said elongate passage is inhibited, said trigger member being spring biased away from a position in which said pressure pad is in firm contact with the spear shaft.

3. A pistol type spear gun for use with a spear shaft, said gun comprising a body member having a handle portion adapted to be grasped in the hand of a user, a trigger member operatively mounted in said handle portion and positioned to be contacted by at least one finger of the user during the grasping of said handle by the hand of the user, an elongate passage extending through said body member in approximately a right angle relationship with said handle, with said passage having a front end and a rear end, said passage being adapted to receive therein a spear shaft having a pointed end and a base end, attachment means on said body member adjacent said rear end of said passage, to which attachment means, each end of an elastic power band can be attached, the base end of the spear shaft being able to be brought into contact with a mid portion of said power band when the spear shaft is moved in the cocking direction, said trigger member being operably mounted in a trigger pocket located in said handle member, said trigger member having an upper interior portion upon which a pressure pad member is located, said pressure pad member being extendable into said elongate passage, and into forcible contact with a spear shaft residing in said elongate passage when said trigger member is squeezed, the spear shaft, when movement thereof in the cocking direction is continued, serving to cause said elastic power band to stretch, with said trigger member, when squeezed by the user, serving as a result of pressure pad member contact to immobilize the spear shaft in a cocked position with the power band in the stretched condition until said trigger member is released, the height of said elongate passage being enlarged above the location where said pressure pad member is brought into contact with the spear shaft, such enlargement of said elongate passage permitting the spear shaft to temporarily assume a bowed condition in which forward movement of the spear shaft through said elongate passage is inhibited, said trigger member being spring biased away from a position in which said pressure pad member is in firm contact with the spear shaft.

4. A pistol type spear gun for use with a spear shaft, said gun comprising a body member having a handle portion adapted to be grasped in the hand of a user, a trigger member operatively mounted in said handle portion and positioned to be contacted by at least one finger of the user during the grasping of said handle by the hand of the user, an elongate passage extending entirely through said body member in approximately a right angle relationship with said handle, with said passage having a front end and a rear end, said passage being adapted to receive therein a spear shaft having a pointed end and a base end, attachment means on said body member to which each end of an elastic power band can be attached, the base end of the spear shaft, upon being extending in a rearward direction through said passage through said body member, being able to be brought into contact with a mid portion of said elastic band, with said trigger member being adapted for holding the spear shaft in a cocked position in said elongate passage when said elastic band has been stretched rearwardly, said trigger member having an upper interior portion upon which a pressure pad is located, said pressure pad being extendable into said elongate passage, and into forcible contact with a spear shaft residing in a cocked position when said trigger member is squeezed, the spear shaft, upon being moved for an additional extent in the rearwardly extending direction at the option of the user, causing said elastic band to stretch further, with the spear shaft being held by the squeezed trigger member in the new rearwardly extended position in which the elastic band has been further stretched, with any continued movement of the spear shaft in the rearwardly extending direction at the option of the user serving to cause said elastic band to stretch still further, with said trigger member, when squeezed by the user, serving as a result of pressure pad contact to immobilize the spear shaft in each new cocked position, with said elastic power band remaining in the stretched condition until the user releases said trigger member, said trigger member being spring biased away from a position in which said pressure pad member is in firm contact with the spear shaft.

5. The pistol type spear gun for use with a spear shaft as recited in claim 4 in which a pivotal mounting is provided for said trigger member in said trigger pocket of said handle, said trigger member having a finger-contacted portion, with latter portion being on the opposite side of said pivotal mounting from said pressure pad member, thus to cause said pressure pad member to tightly bear against the spear shaft when the finger-contacted portion is squeezed.

* * * * *